US010202750B2

(12) United States Patent
Chou

(10) Patent No.: US 10,202,750 B2
(45) Date of Patent: Feb. 12, 2019

(54) STRUCTURE AND METHOD FOR INSTALLING BATHROOM PLUMBING

(71) Applicants: Vicki-Fen Chou, Taoyuan (TW); Philip Trinh, Taoyuan (TW); Christine Trinh, Taoyuan (TW)

(72) Inventor: Song Chou, Taoyuan (TW)

(73) Assignees: Vicki-Fen Chou, Taoyuan (TW); Philip Trinh, Taoyuan (TW); Christine Trinh, Taoyuan (TW)

( * ) Notice: Subject to any disclaimer, the term of this patent is extended or adjusted under 35 U.S.C. 154(b) by 0 days.

(21) Appl. No.: 16/008,446

(22) Filed: Jun. 14, 2018

(65) Prior Publication Data

US 2018/0291608 A1 Oct. 11, 2018

Related U.S. Application Data

(63) Continuation-in-part of application No. 15/226,222, filed on Aug. 2, 2016.

(30) Foreign Application Priority Data

Mar. 3, 2016 (TW) ..... 105106447 A

(51) Int. Cl.

| | |
|---|---|
| ***E03D 11/13*** | (2006.01) |
| ***E03D 11/16*** | (2006.01) |
| ***E03C 1/122*** | (2006.01) |
| ***E03C 1/14*** | (2006.01) |
| ***E04B 2/74*** | (2006.01) |

(52) U.S. Cl.
CPC ..... *E03D 11/135* (2013.01); *E03C 1/1222* (2013.01); *E03D 11/16* (2013.01); *E03C 1/14* (2013.01); *E04B 2/7433* (2013.01)

(58) Field of Classification Search
CPC ..... E03D 11/16; E03D 11/135; E03C 1/222; E03C 1/14; E04B 2/7433
USPC ..... 4/252.1
See application file for complete search history.

(56) References Cited

U.S. PATENT DOCUMENTS

| | | | |
|---|---|---|---|
| 4,860,503 | A | 8/1989 | Palmer |
| 9,708,805 | B2 | 7/2017 | Seggio |
| 2017/0002579 | A1 | 1/2017 | French |

*Primary Examiner* — Tuan N Nguyen
(74) *Attorney, Agent, or Firm* — Locke Lord LLP; Tim Tingkang Xia, Esq.

(57) ABSTRACT

The present invention provides a structure for installing bathroom plumbing, the structure comprising: a structural post provided with at least one board installed parallel to the structural post and at least one building floor installed perpendicular to the structural post, the at least one board and the structural post defining a first accommodation space together, the first accommodation space provided with a first discharge pipe, the building floor forming a downward recessed area adjacent to the structural post; at least one detachable floor panel installed at the downward recessed area of the building floor to define a second accommodation space, the second accommodation space communicating with the first accommodation space; at least one toilet disposed on the at least one detachable floor panel.

10 Claims, 9 Drawing Sheets

STRUCTURE AND METHOD FOR INSTALLING BATHROOM PLUMBING

CROSS-REFERENCE TO RELATED APPLICATION

This application is a continuation-in-part of U.S. application Ser. No. 15/226,222, filed on Aug. 2, 2016, which claims priority to Taiwan Patent Application No. 105106447, filed on Mar. 3, 2016. The above applications are both herein incorporated by reference in their entireties.

BACKGROUND OF THE INVENTION

Field of the Invention

The present invention relates to a structure and a method for installing bathroom plumbing, and more particularly, to a structure and a method for installing bathroom plumbing which allow the residents to choose their desired locations for installing bathroom fixtures.

Prior Art

The toilet has become a popular sanitary ware and widely used since its invention. In recent years, the toilet has been equipped with a number of additional functions, such as warm-water cleaning and seat heating, to optimize the user experience.

FIG. 9 is a schematic view showing a conventional structure for installing toilet piping. Despite advanced manufacturing techniques and functions of toilets, the limitation that a conventional toilet 100 must be installed on a floor 101 of a building remains unchanged. The conventional toilet 100 is typically made of a ceramic material, and using concrete, which is made by mixing cement and sand with water, as an adhesive to install the ceramic toilet bowl on the concrete floor 101 is a conventional method. Traditionally, a layer of concrete has to be paved on a predetermined location before the conventional toilet 100 is installed. Next, a bottom of the conventional toilet 100 and a discharge pipe 102 are aligned, and then a construction worker trowels the extra concrete off the bottom of the toilet 100 and smoothes the concrete surface so that the conventional toilet 100 looks like being directly adhered to the floor 101.

After the conventional toilet 100 has been installed on the floor 101, the movement of the conventional toilet 100 to another location requires laborious work, which involves breaking the area of the floor 101 where the conventional toilet 100 was originally installed and pre-installing a discharge pipe 102 at the location where the conventional toilet 100 is to be installed. Afterwards, repairs must be done to the damaged area.

The conventional construction method involves reserving an accommodation space 111 in a structural post 110 to house a discharge pipe 112, and the discharge pipe 102 has one end connected to the bottom of the conventional toilet 100 and the other end connected to the discharge pipe 112 so that the waste to be discharged by the conventional toilet 100 is transferred to the discharge pipe 112 via the discharge pipe 102 and then drained out. Such a conventional construction method has some disadvantages and inconvenience. For example, when the discharge pipe 112 is damaged or worn out, the maintenance and replacement of the discharge pipe 112 is difficult because it is disposed inside the structural post 110. Furthermore, the conventional toilet 100 has to be installed in a stationary location, and thus it is unable to install the conventional toilet 100 in various locations according to the residents' needs.

Therefore, a need exists in the art for a structure and a method for installing toilet piping that allow the residents to choose their desired locations for installing toilets.

SUMMARY

An object of the present invention is to provide a structure for installing bathroom plumbing in which a toilet is disposed on and removable with a detachable floor panel within a predetermined area rather than being fixed in a stationary location. The present invention further provides a method for installing bathroom plumbing.

To achieve the aforementioned object of the present invention, there is provided a structure for installing bathroom plumbing, the structure comprising: a structural post provided with at least one board installed parallel to the structural post and at least one building floor installed perpendicular to the structural post, the at least one board and the structural post defining a first accommodation space together, the first accommodation space provided with a first discharge pipe, the building floor forming a downward recessed area adjacent to the structural post; at least one detachable floor panel installed at the downward recessed area of the building floor to define a second accommodation space, the second accommodation space communicating with the first accommodation space; at least one toilet disposed on the at least one detachable floor panel; and a second discharge pipe disposed in the second accommodation space, the second discharge pipe having one end connected to the at least one toilet and the other end connected to the first discharge pipe.

Preferably, the second accommodation space beneath the at least one detachable floor panel is provided with a plurality of light steel rods configured to support the at least one detachable floor panel.

Preferably, the at least one detachable floor panel is at least a part of a floor in a bathroom.

Preferably, the bathroom is provided with a bathtub or a sink, and a part of a drain for the bathtub or the sink is disposed in the second accommodation space and is connected to the first discharge pipe.

Preferably, the first accommodation space is provided with a plurality pipes including at least one water pipe or at least one circuit pipe.

To achieve the aforementioned object of the present invention, there is provided a method for installing bathroom plumbing, the method comprising the steps of: providing a structural post and installing at least one board parallel to the structural post around a periphery thereof, the at least one board and the structural post defining a first accommodation space in which a first discharge pipe is disposed; installing at least one building floor perpendicular to the structural post, the building floor forming a downward recessed area adjacent to the structural post; installing at least one detachable floor panel at the downward recessed area to define a second accommodation space and causing the second accommodation space to communicate with the first accommodation space; disposing at least one toilet on the at least one detachable floor panel; and disposing a second discharge pipe in the second accommodation space so that the two ends of the second discharge pipe are connected to the at least one toilet and the first discharge pipe, respectively.

Preferably, the method for installing bathroom plumbing further comprises the step of installing a plurality of light steel rods in the second accommodation space to support the at least one detachable floor panel.

Preferably, the method for installing bathroom plumbing further comprises the step of installing a bathtub or a sink, wherein a part of a drain for the bathtub or the sink is disposed in the second accommodation space and is connected to the first discharge pipe.

Preferably, a third accommodation space is formed between the downward recessed area of the building floor and a downstairs ceiling, and the third accommodation space is suitable for installation of a lighting fixture on the downstairs ceiling.

DETAILED DESCRIPTION

While the invention will be fully described with exemplary embodiments below by reference to the appended drawings, it is to be understood that a skilled person in the art can make various modifications to the present invention and also achieve the same effect as the present invention. Hence, it is to be understood that the following description is construed as a broad disclosure to a skilled person in the art, and the present invention is not limited thereto.

Figure 1:
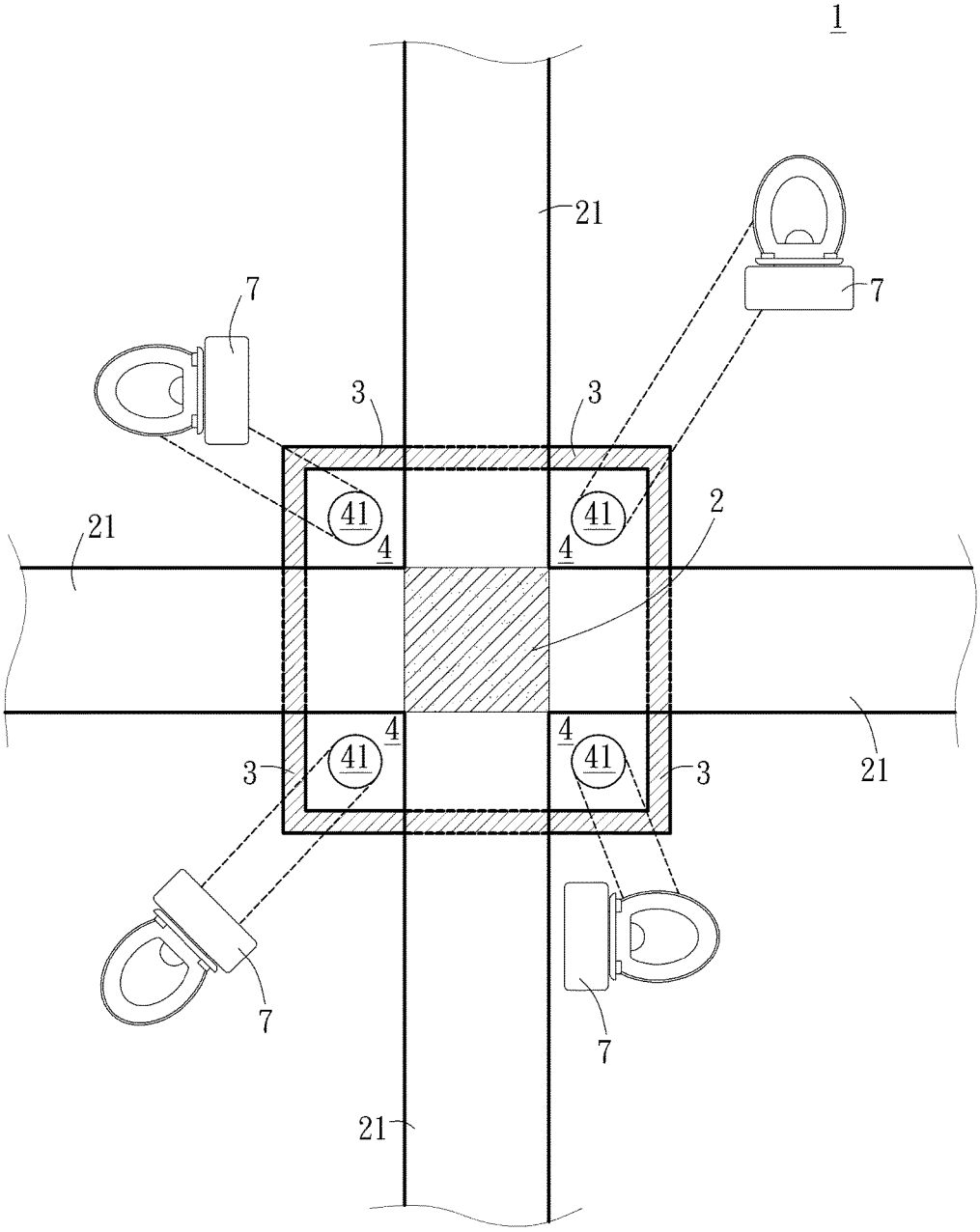
FIG. 1 is a schematic view showing a structure for installing bathroom plumbing in accordance with a first embodiment of the present invention.
Figure 2:
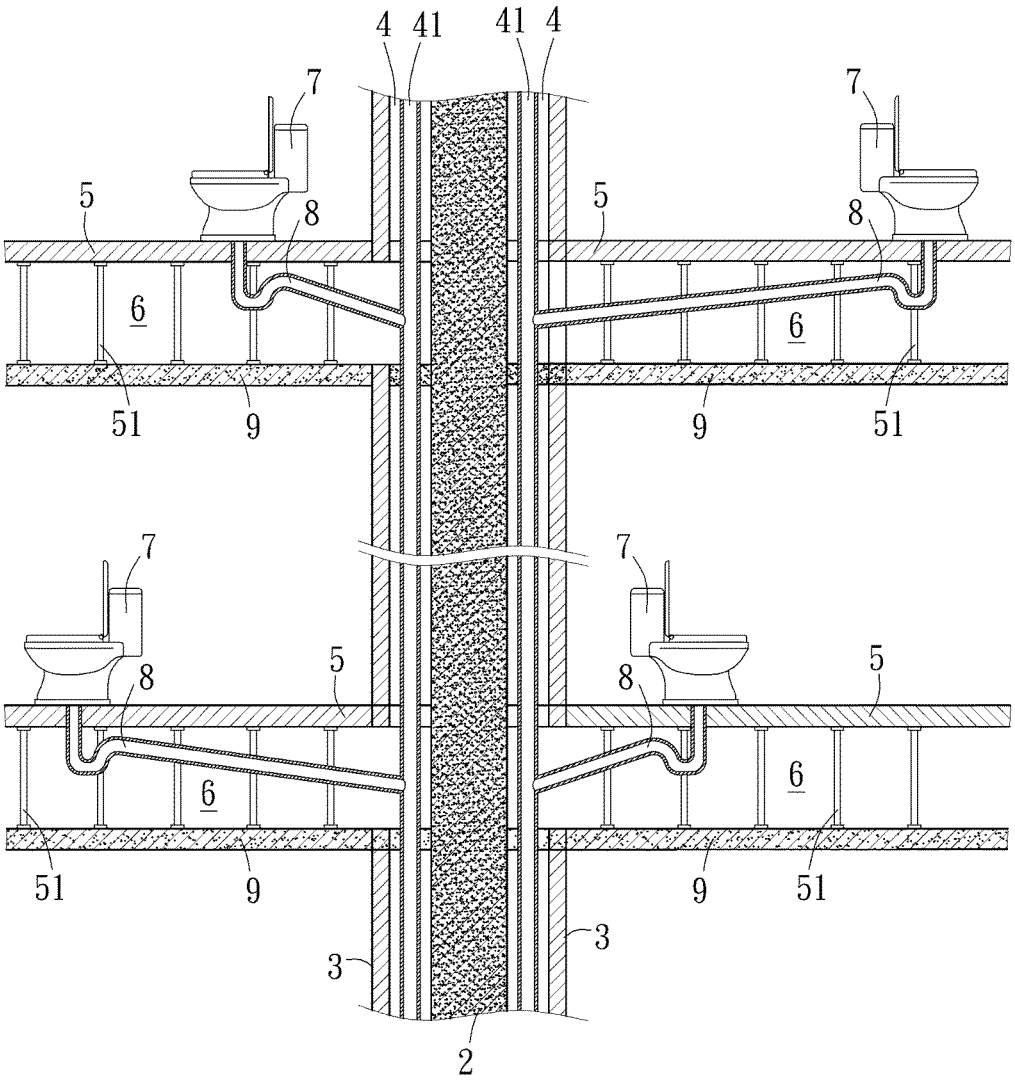
FIG. 2 is another schematic view showing the structure for installing bathroom plumbing in accordance with the first embodiment of the present invention.
Figure 3:
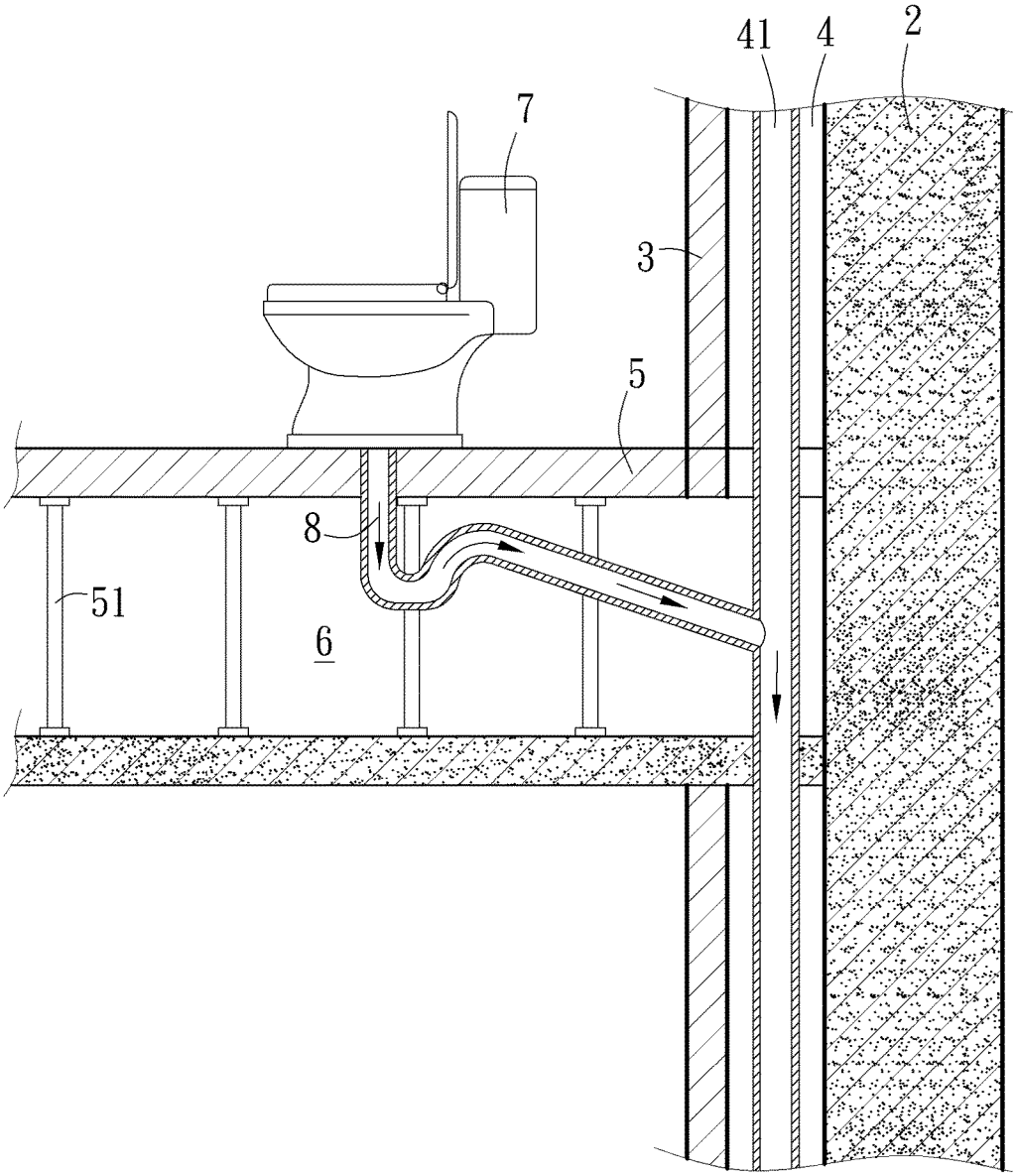
FIG. 3 is an enlarged partial view showing the upper left corner of FIG. 2.

FIGS. 1 and 2 are schematic views showing a structure for installing bathroom plumbing in accordance with a first embodiment of the present invention, and FIG. 3 is an enlarged partial view showing the upper left corner of FIG. 2. According to the first embodiment of the present invention, there is provided a structure 1 for installing toilet piping, the structure 1 comprising: a structural post 2 with a plurality beams 21 extending outwards therefrom and in the form of a cross, four boards 3 parallel or perpendicular to one another being disposed around a periphery of and in parallel with the structural post 2 and defining first accommodation spaces 4 together with the structural post 2; a plurality of detachable floor panels 5 defining second accommodation spaces 6 therebeneath, the second accommodation spaces 6 communicating with the first accommodation spaces 4; a plurality of toilets 7 disposed on the plurality of detachable floor panels 5; and a second discharge pipe 8 disposed in a corresponding one of the second accommodation spaces 6. Specifically, the four boards 3 are positioned beneath the plurality of beams 21. In FIG. 1, each of the four first accommodation spaces 4 is provided with a first discharge pipe 41, which is preferably a circular pipe. Specifically, the second discharge pipe 8 has one end connected to the bottom of one of the plurality of toilets 7 and the other end connected to the first discharge pipe 41, and is configured to transfer and discharge waste.

Preferably, the second accommodation space 6 beneath one of the plurality of detachable floor panels 5 is provided with a plurality of light steel rods 51 configured to support between a floor 9 and the corresponding detachable floor panel 5 of a building so that the corresponding detachable floor panel 5 can support heavier loads. It is worth mentioning that one end of the second discharge pipe 8 passes through the corresponding detachable floor panel 5 to communicate with the bottom of the corresponding toilet 7; in this way, the waste to be drained by the corresponding toilet 7 can be transferred to the first discharge pipe 41 via the second discharge pipe 8 (in a direction indicated by the arrows as shown in FIG. 3). As shown in FIG. 1, the plurality of toilets 7 can be disposed in any directions with respect to the structural post 2. In FIG. 2, the plurality of toilets 7 can be disposed in different floors and arranged at different distances from the structural post 2 according to the residents' needs. The detachable floor panel 5 is removable and detachable so that the second discharge pipe 8 can be embedded in the second accommodation space 6 and extend through the corresponding detachable floor panel 5, the plurality of light steel rods 51 and the floor 9.

Figure 4:
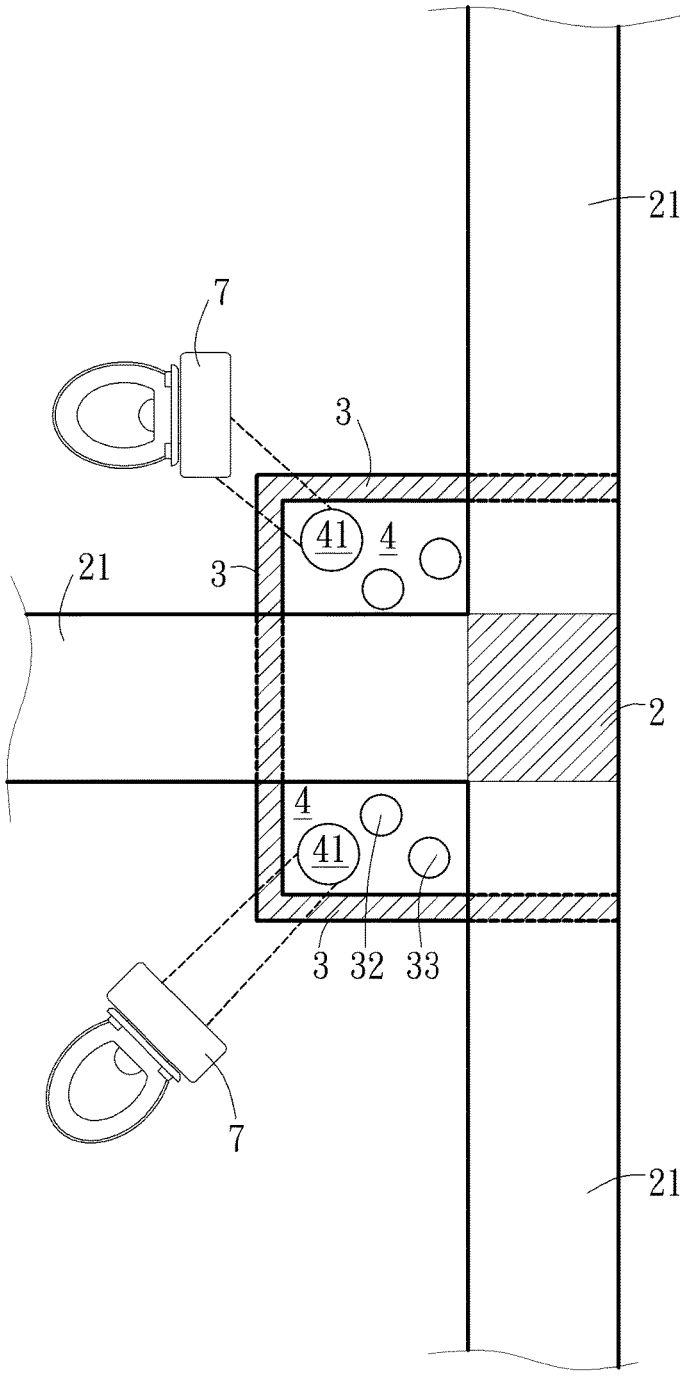
FIG. 4 is a schematic view showing a structure for installing bathroom plumbing in accordance with a second embodiment of the present invention.

FIG. 4 is a schematic view showing a structure for installing bathroom plumbing in accordance with a second embodiment of the present invention. The second embodiment illustrated in FIG. 4 is different from the first embodiment illustrated in FIG. 1 in that (1) the plurality of beams 21 form a rightwardly turned T-shape (a vertical right beam 21 and a horizontal left beam 21, as shown in FIG. 4), and three boards 3 parallel or perpendicular to one another are disposed around a periphery of and in parallel with the structural post 2 and define first accommodation spaces 4 together with the structural post 2, and that (2) in addition to a first discharge pipe 41, each of the two first accommodation spaces 4 in FIG. 4 is provided with a plurality of pipes that may include a water pipe 32, a circuit pipe 33, etc. according to the residents' needs.

It is worth mentioning that the rightwardly turned T-shape formed of the beams 21 of the second embodiment is merely an example, and that the beams 21 can form a T-shape (a horizontal upper beam 21 and a vertical lower beam 21), a leftwardly turned T-shape (a vertical left beam 21 and a horizontal right beam 21) or an inverted T-shape (a vertical upper beam 21 and a horizontal lower beam 21).

Figure 5:
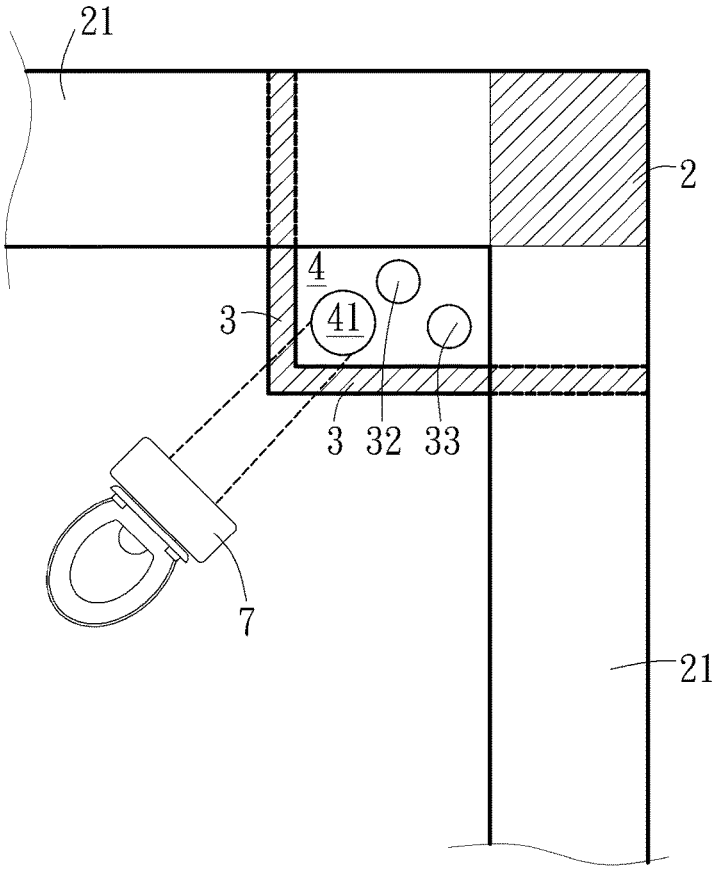
FIG. 5 is a schematic view showing a structure for installing bathroom plumbing in accordance with a third embodiment of the present invention.

FIG. 5 is a schematic view showing a structure for installing bathroom plumbing in accordance with a third embodiment of the present invention. The third embodiment illustrated in FIG. 5 is different from the first embodiment illustrated in FIG. 1 in that (1) two beams 21 of the third embodiment form an inwardly turned inverted L-shape (a horizontal left beam 21 and a vertical right beam 21, as shown in FIG. 5), and two boards 3 perpendicular to each other are disposed around a periphery of and in parallel with the structural post 2 and define a first accommodation space 4 together with the structural post 2, and that (2) in addition to the first discharge pipe 41, the first accommodation space 4 is further provided with a plurality of pipes that may include a water pipe 32, a circuit pipe 33, and etc. according to the residents' needs.

It is worth mentioning that the inwardly turned inverted L-shape formed of the beams 21 of the third embodiment is merely an example, and that the beams 21 can form an inverted L-shape (a vertical left beam 21 and a horizontal right beam 21), an inwardly turned L-shape (a horizontal left beam 21 and a vertical right beam 21) and an L-shape (a vertical left beam 21 and a horizontal right beam 21).

Figure 6:
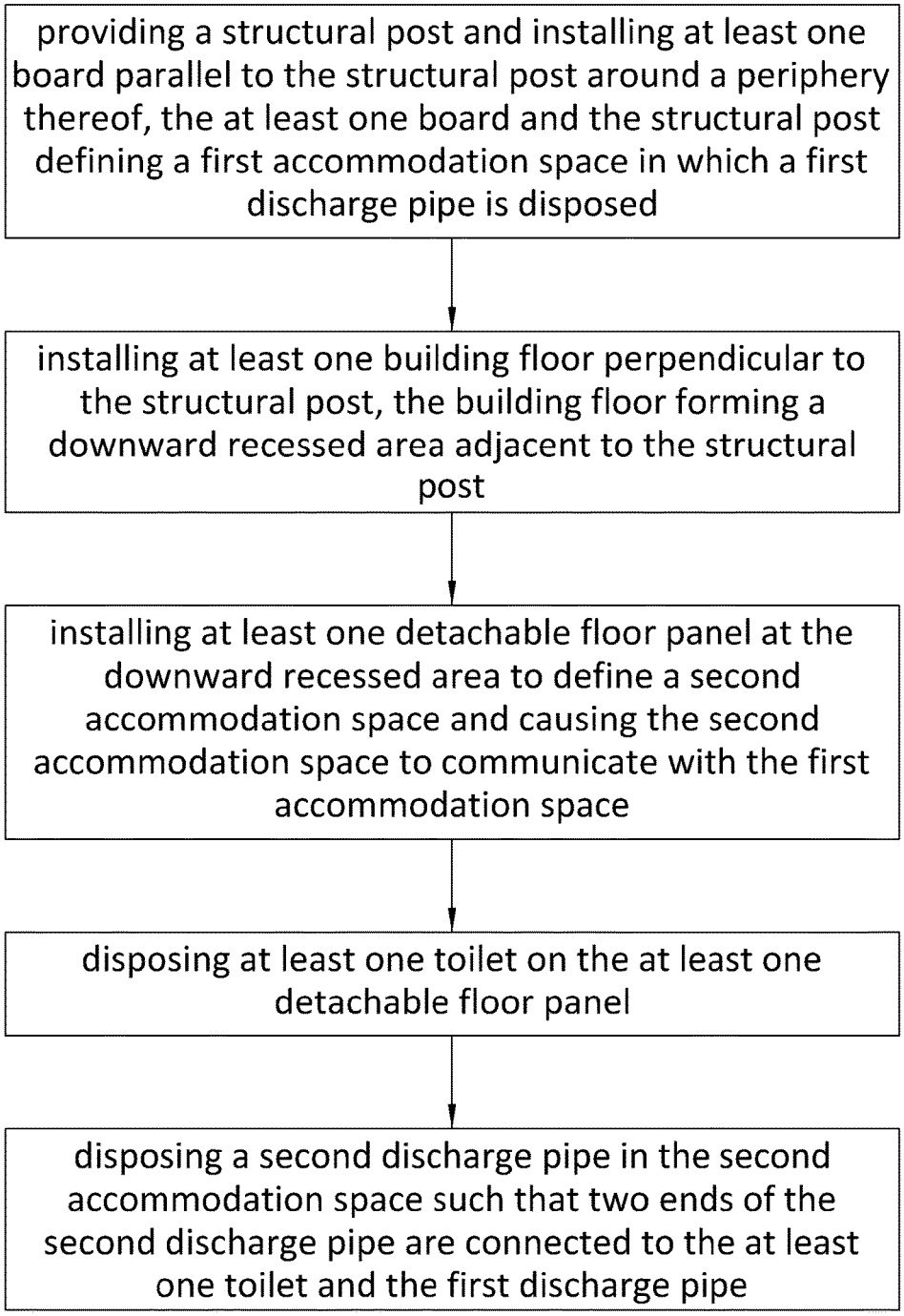
FIG. 6 is a flowchart showing a method for installing bathroom plumbing of the present invention.

FIG. 6 is a flowchart showing a method for installing bathroom plumbing of the present invention. According to the present invention, there is provided a method for installing bathroom plumbing, the method comprising the following steps:

First, install at least one board around the periphery of a structural post 2, wherein the at least one board is parallel to the structural post 2 and defines a first accommodation space 4 together with the structural post 2, and a first discharge pipe 41 is disposed in the first accommodation space 4. Specifically, a plurality of boards 3 parallel or perpendicular to one another are disposed around the periphery of and in parallel with the structural post 2 and define the first accommodation space 4 together with the structural post 2. Specifically, the plurality of boards 3 are disposed beneath the plurality of beams 21. It is worth mentioning that the number of the boards 3 may be four, three or two, and that these boards are parallel or perpendicular to one another.

Figure 7:
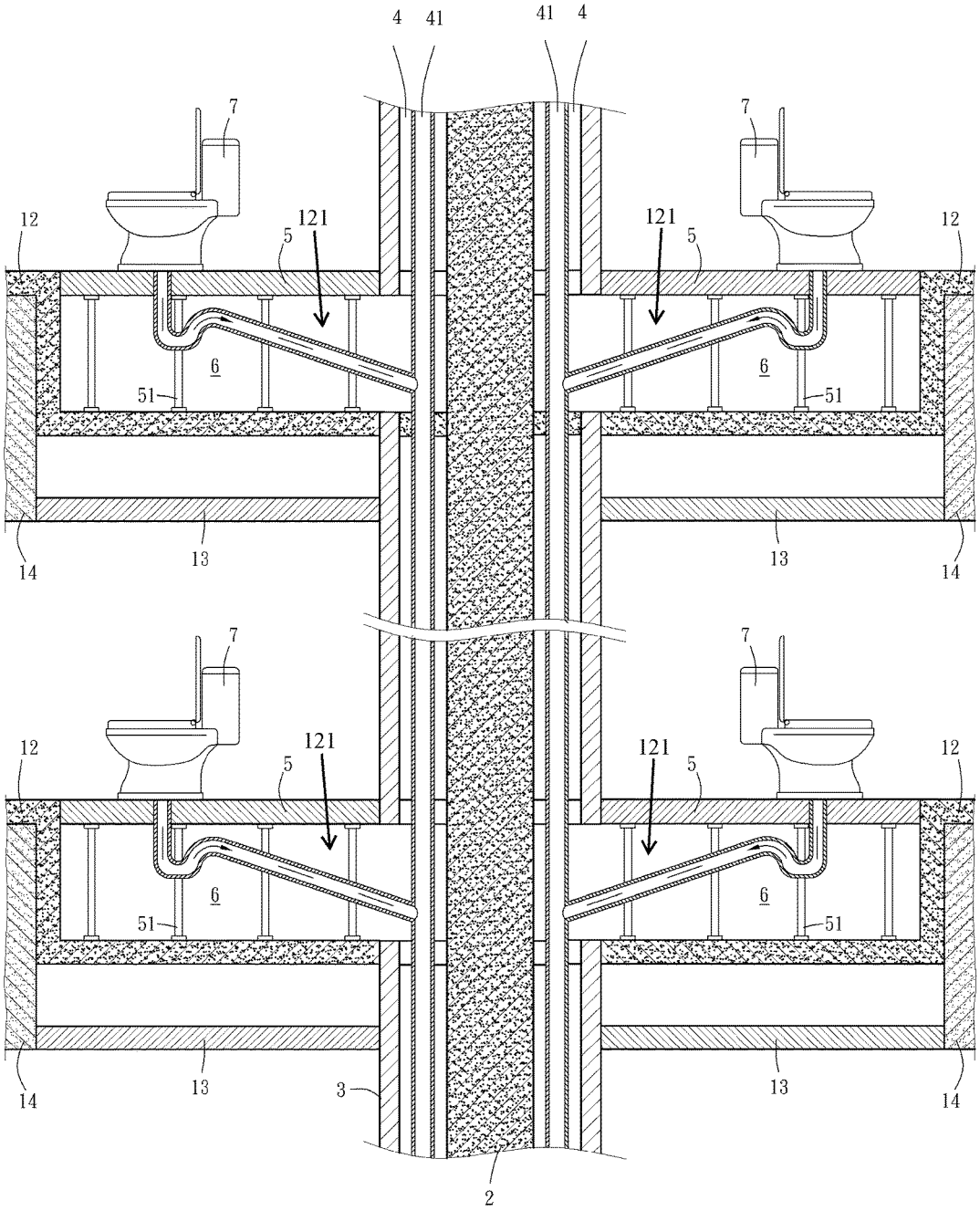
FIG. 7 is a schematic view showing a structure for installing bathroom plumbing in accordance with a fourth embodiment of the present invention.

Next, install at least one building floor 12 perpendicular to the structural post 2, wherein the building floor 12 forms a downward recessed area 121 adjacent to the structural post 2 (as shown in FIG. 7).

Next, install at least one detachable floor panel 5 at the downward recessed area 121 of the building floor 12 to define a second accommodation space 6, and cause the second accommodation space 6 to communicate with the first accommodation space 4, wherein the second accommodation space 6 beneath the at least one detachable floor panel 5 is provided with a plurality of light steel rods 51 configured to support the building floor 12 and the at least one detachable floor panel 5, so that the at least one detachable floor panel 5 can support heavier loads.

Next, dispose at least one toilet 7 on the at least one detachable floor panel 5. The at least one toilet 7 can be disposed in any direction with respect to the structural post 2, and can be disposed in different floors and arranged at different distances from the structural post 2 according to the residents' needs. The at least one detachable floor panel 5 is removable and detachable so that the location where the at least one toilet 7 is to be installed can be customized.

Next, dispose a second discharge pipe 8 in the second accommodation space 6 such that two ends of the second discharge pipe 8 connect to the at least one toilet 7 and the first discharge pipe 41 respectively, wherein one end of the second discharge pipe 8 passes through the at least one detachable floor panel 5 to connect to the bottom of the at least one toilet 7. Specifically, the second discharge pipe 8 can be embedded in the second accommodation space 6 and extend through the at least one detachable floor panel 5, the plurality of light steel rods 51 and the building floor 12. Furthermore, a plurality of pipes that include a water pipe 32 and a circuit pipe 33 can be disposed in the first accommodation space 4.

Figure 8:
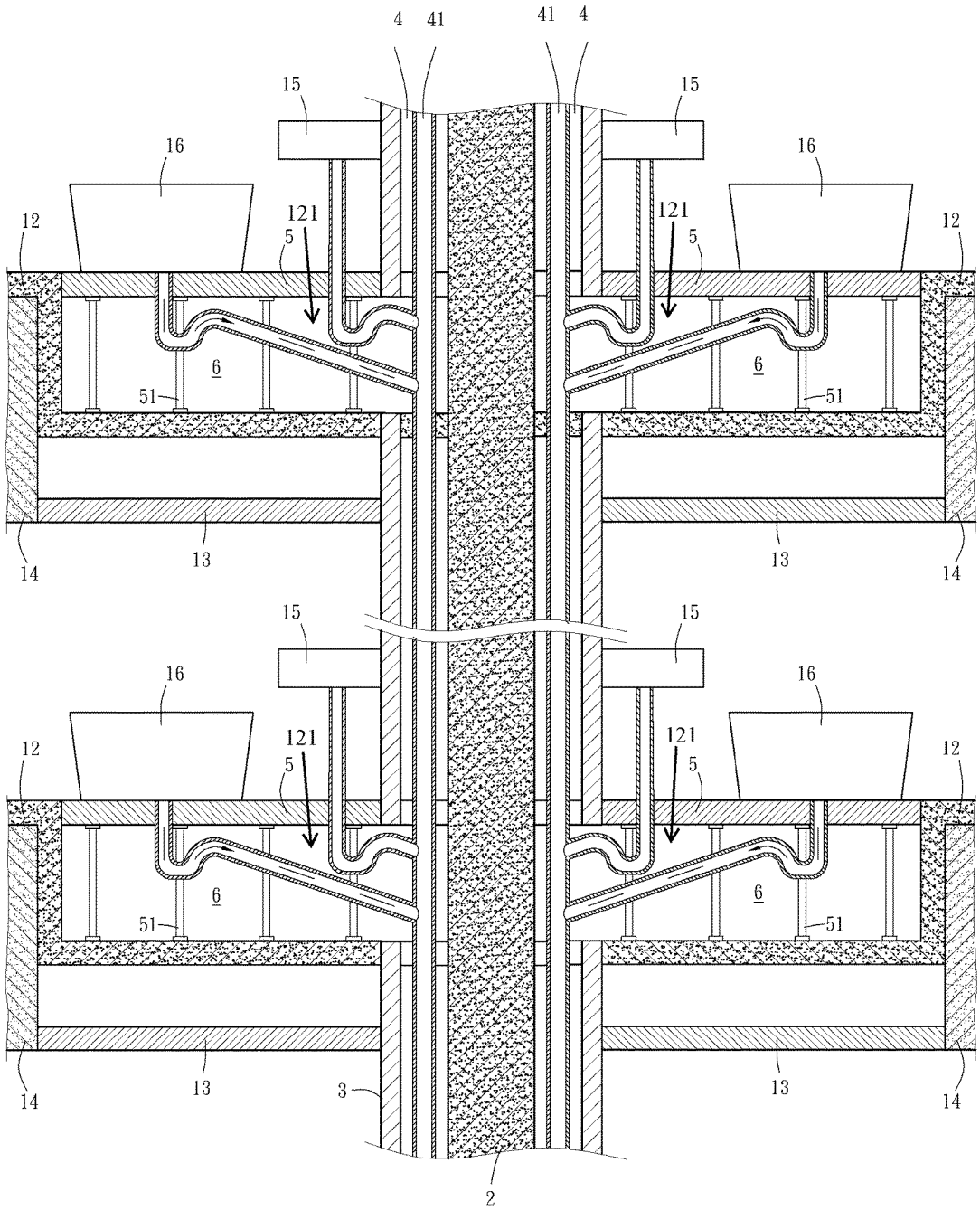
FIG. 8 is a schematic view showing a structure for installing bathroom plumbing in accordance with a fifth embodiment of the present invention.
Figure 9:
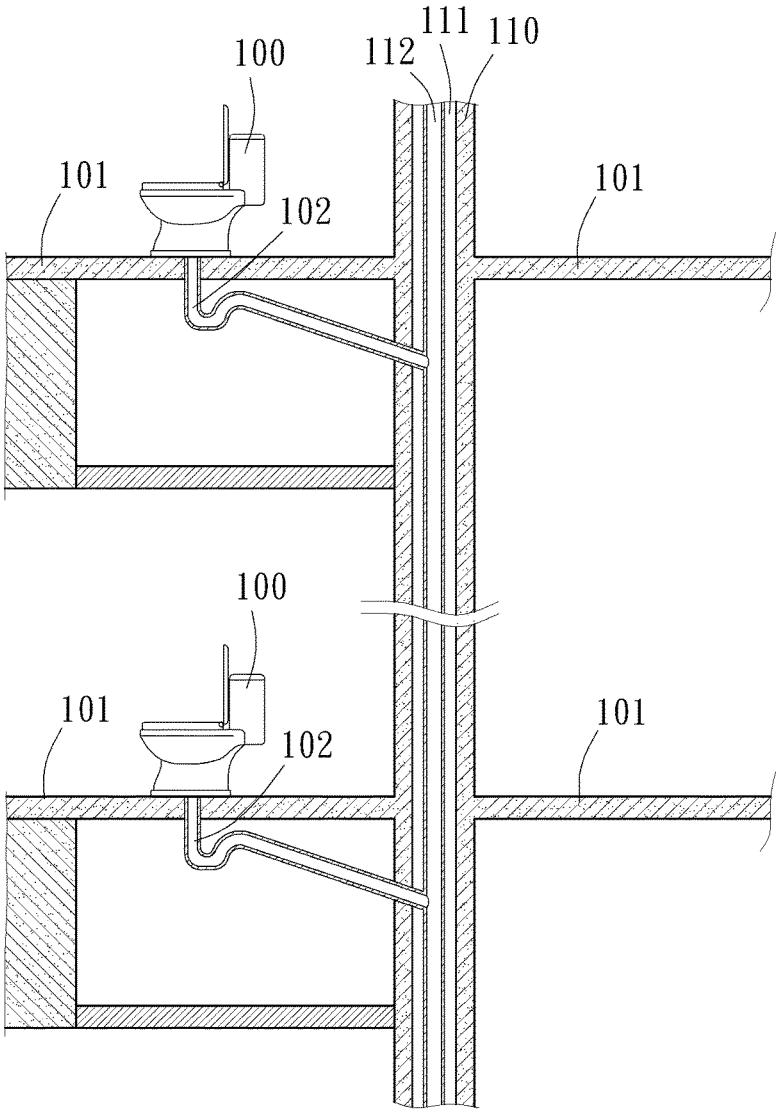
Fig.9 (Prior Art)
FIG. 9 is a schematic view showing a conventional structure for installing toilet piping.

FIG. 7 is a schematic view showing a structure for installing bathroom plumbing in accordance with a fourth embodiment of the present invention. The structure for installing bathroom plumbing according to this invention comprises a structural post 2, at least one detachable floor panel 5, at least one toilet 7, and a second discharge pipe 8. The structural post 2 is provided with at least one board 3 installed parallel to the structural post 2 and at least one building floor 12 installed perpendicular to the structural post 2. The board 3 and the structural post 2 together define a first accommodation space 4, which is provided with a first discharge pipe 41. The building floor 12 forms a downward recessed area 121, which is adjacent to the structural post 2. The detachable floor panel 5 is installed at the downward recessed area 121 of the building floor 12 to define a second accommodation space 6, which communicates with the first accommodation space 4. The toilet 7 is disposed on the detachable floor panel 5. A second discharge pipe 8 is disposed in the second accommodation space 6; the second discharge pipe 8 has one end connected to the toilet 7 and the other end connected to the first discharge pipe 41. The second accommodation space 6 beneath the detachable floor panel 5 is provided with a plurality of light steel rods 51 configured to support the detachable floor panel 5. The detachable floor panel 5 is at least a part of the building floor 12 in a bathroom. The bathroom may be provided with a bathtub 16 or a sink 15 (as shown in FIG. 8); specifically, a part of a drain for the bathtub 16 or the sink 15 is disposed in the second accommodation space 6 and is connected to the first discharge pipe 41. The first accommodation space 4 is provided with a plurality of pipes, which may include at least one water pipe 32 or at least one circuit pipe 33. In addition, a third accommodation space 131 is formed between the downward recessed area 121 of the building floor 12 and a downstairs ceiling 13. The third accommodation space 131 is suitable for installation of a lighting fixture on the ceiling 13. The design of the downward recessed area 121 in this embodiment has certain chief advantages worth noting. Because of the downward recessed area, the detachable floor panel 5 and the building floor 12 can be positioned at the same height horizontally. Moreover, the additional space created by the downward recessed area can well accommodate plumbing pipes, thereby allowing a greater ceiling height for the bathroom while avoiding a tiny, confined space.

FIG. 8 is a schematic view showing a structure for installing bathroom plumbing in accordance with a fifth embodiment of the present invention. The fifth embodiment illustrated in FIG. 8 is different from the fourth embodiment illustrated in FIG. 7 in that the bathroom is provided with other bathroom fixtures, including a bathtub 16 and a sink 15. Specifically, a part of a drain for the bathtub 16 or the sink 15 is disposed in the second accommodation space 6 and is connected to the first discharge pipe 41.

The structure and method for installing bathroom plumbing of the present invention are characterized in that: a structural post is provided with boards installed parallel to the structural post and at least one building floor installed perpendicular to the structural post; the boards are parallel or perpendicular to one another and define a first accommodation space together with the structural post; a first discharge pipe is disposed in the first accommodation space; the building floor forms a downward recessed area adjacent to the structural post; a detachable floor panel is installed at the downward recessed area of the building floor to define a second accommodation space; a second discharge pipe is disposed in the second accommodation space; and the second discharge pipe has one end connected to the bottom of a toilet (or bathtub or sink), and the other end connected to the first discharge pipe. Given the above features of the invention, the toilet is removable with a detachable floor panel rather than being fixed in a stationary location. Therefore, the location where the toilet is to be installed is more flexible. In addition, a third accommodation space is formed between the downward recessed area of the building floor and a downstairs ceiling, and the third accommodation space is suitable for installation of a lighting fixture on the downstairs ceiling.

It will be understood that the present invention is not limited to the embodiments described above, and that various variation or modifications can be made without departing from the scope and spirit of the present invention.

What is claimed is:

1. A structure for installing bathroom plumbing, the structure comprising:

a structural post provided with at least one board installed parallel to the structural post and at least one building floor installed perpendicular to the structural post, the at least one board and the structural post defining a first accommodation space together, the first accommodation space being provided with a first discharge pipe, the building floor forming a downward recessed area adjacent to the structural post;

at least one detachable floor panel installed at the downward recessed area of the building floor to define a second accommodation space, the second accommodation space communicating with the first accommodation space;

at least one toilet disposed on the at least one detachable floor panel; and a second discharge pipe disposed in the second accommodation space, the second discharge pipe having one end connected to the at least one toilet and the other end connected to the first discharge pipe.

2. The structure for installing bathroom plumbing of claim 1, wherein the second accommodation space beneath the at least one detachable floor panel is provided with a plurality of light steel rods configured to support the at least one detachable floor panel.

3. The structure for installing bathroom plumbing of claim 1, wherein the at least one detachable floor panel is at least a part of a floor in a bathroom.

4. The structure for installing bathroom plumbing of claim 3, wherein the bathroom is provided with a bathtub or a sink, and a part of a drain for the bathtub or the sink is disposed in the second accommodation space and is connected to the first discharge pipe.

5. The structure for installing bathroom plumbing of claim 1, wherein the first accommodation space is provided with a plurality of pipes that include at least one water pipe or at least one circuit pipe.

6. The structure for installing bathroom plumbing of claim 1, wherein a third accommodation space is formed between the downward recessed area of the building floor and a downstairs ceiling, and the third accommodation space is suitable for installation of a lighting fixture on the downstairs ceiling.

7. A method for installing bathroom plumbing, the method comprising the steps of:

providing a structural post and installing at least one board parallel to the structural post around a periphery thereof, the at least one board and the structural post defining a first accommodation space in which a first discharge pipe is disposed;

installing at least one building floor perpendicular to the structural post, the building floor forming a downward recessed area adjacent to the structural post;

installing at least one detachable floor panel at the downward recessed area to define a second accommodation space and causing the second accommodation space to communicate with the first accommodation space;

disposing at least one toilet on the at least one detachable floor panel; and disposing a second discharge pipe in the second accommodation space such that two ends of the second discharge pipe are connected to the at least one toilet and the first discharge pipe, respectively.

8. The method for installing bathroom plumbing of claim 7, further comprising the step of installing a plurality of light steel rods in the second accommodation space to support the at least one detachable floor panel, wherein the at least one detachable floor panel is at least a part of a floor in a bathroom.

9. The method for installing bathroom plumbing of claim 8, further comprising the step of installing a bathtub or a sink, wherein a part of a drain for the bathtub or the sink is disposed in the second accommodation space and is connected to the first discharge pipe.

10. The method for installing bathroom plumbing of claim 7, wherein a third accommodation space is formed between the downward recessed area of the building floor and a downstairs ceiling, and the third accommodation space is suitable for installation of a lighting fixture on the downstairs ceiling.

* * * * *